US006158665A

United States Patent [19]

Moroi et al.

[11] Patent Number: 6,158,665

[45] Date of Patent: Dec. 12, 2000

[54] HEAT GENERATOR

[75] Inventors: Takahiro Moroi; Hidefumi Mori; Kenji Takenaka; Tatsuyuki Hoshino, all of Kariya, Japan

[73] Assignee: Kabushiki Kaisha Toyoda Jidoshokki Seisakusho, Kariya, Japan

[21] Appl. No.: 09/268,432

[22] Filed: Mar. 12, 1999

[30] Foreign Application Priority Data

Mar. 19, 1998 [JP] Japan ..... 10-069972

[51] Int. Cl.[7] ..... B60H 1/02

[52] U.S. Cl. ..... 237/12.3 R; 126/247

[58] Field of Search ..... 237/12.3 R, 12.3 B; 122/26; 126/247; 123/142.5 R

[56] References Cited

U.S. PATENT DOCUMENTS 4,993,377 2/1991 Itakura .

5,799,619 9/1998 Hoshino et al. ..... 122/26

FOREIGN PATENT DOCUMENTS 3-98107 10/1991 Japan .

*Primary Examiner*—Harold Joyce
*Assistant Examiner*—Derek S. Boles
*Attorney, Agent, or Firm*—Morgan & Finnegan, L.L.P.

[57] ABSTRACT

A viscous fluid type heat generator, which shears viscous fluid for generating heat. The heater includes a rotor located in a heating chamber and viscous fluid accommodated in the heating chamber. The rotor is rotated integrally with a drive shaft by a vehicle engine. The rotor includes a boss for attaching the rotor to the drive shaft. The boss has a double-ringed structure for reinforcing the attachment of the boss to the drive shaft.

24 Claims, 5 Drawing Sheets

HEAT GENERATOR

BACKGROUND OF THE INVENTION

The present invention relates to a heat generator that generates heat by shearing viscous fluid.

A typical heat generator used as an auxiliary heat source for a vehicle has a housing and a rotor. The rotor, which has a specially designed shape, is rotated to shear silicone oil filling the housing, to generate heat. For example, Japanese Unexamined Patent Publication No. 2-246823 discloses a rotor having labyrinthine grooves. Japanese Unexamined Utility Model Publication No. 3-98107 discloses a rotor having multiple fins. The applicant company has also proposed a heat generator having a disk-shaped rotor.

A conventional disk-shaped rotor is made by machining carbon steel, such as S45C, and has a hole in the center. The diameter of the hole is slightly smaller than that of a drive shaft to which the rotor is to be fitted. The rotor is secured to one end of the drive shaft by press fitting the drive shaft into the hole of the rotor. When machining the rotor, a boss is formed about the hole. The boss is axially longer than the rest of the rotor. The boss increases the contact area between the rotor and the shaft thereby securely fixing the rotor on the shaft. The greater the force acting on the contact area, due to the press fit, the less the connection between the rotor and the drive shaft is affected by temperature changes in the heat generator.

However, machining the rotor from steel is difficult and burdensome, thus increasing costs. Heat generators having rotors as described above are therefore not suitable for mass production. Thus, a relatively thin steel plate made of SPCC or SPHC has been tested as a material for a rotor. That is, a plate made of SPCC or SPHC was deep-drawn into a rotor. However, steel plates that are used in presswork have a relatively weak tensile strength. The rotor is therefore hardened immediately after being pressed for improving the tensile strength of parts in the rotor (especially, the boss). The hardening improves the tensile strength of the rotor. The rotor is therefore securely fixed to the drive shaft.

However, hardening is very costly. Further, rotors are often deformed by hardening. Therefore hardened plate often needs to be processed to correct its deformation. Approximately half of the manufacturing cost of a heat generator can be spent on hardening of the rotor and the process thereafter. Thus, as far as cost saving is concerned, there is no reason to manufacture the rotor by pressing instead of by machining.

SUMMARY OF THE INVENTION

Accordingly, it is an objective of the present invention to provide an inexpensive heat generator having a rotor that is securely fixed to a drive shaft.

To achieve the above objective, the present invention provides a heat generator having a housing, a heating chamber defined in the housing for containing a viscous fluid, a rotor located in the heating chamber. The rotor rotates to shear the viscous fluid to heat the viscous fluid. The heat generator includes a drive shaft, a coupler and a fastener. The drive shaft is rotatably supported in the housing. The coupler is formed on the rotor and couples the rotor to the drive shaft. The fastener tightens the coupler against the drive shaft.

The present invention is also embodied in a method for manufacturing a heat generator having a housing for containing a viscous fluid, a heating chamber defined in the housing and a rotor located in the heating chamber. The rotor rotates to shear the viscous fluid to heat the viscous fluid. The method includes forming a coupler for coupling the rotor to the drive shaft, on the rotor. The coupler is formed by pressing the center of a plate to form a projection that conforms to the shape of the drive shaft. The method includes bending a distal section of the coupler by 180 degrees to form a double-ringed cylindrical structure. The method also includes fixing the coupler to the drive shaft by inserting the drive shaft into the coupler.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENT

An on-vehicle heat generator according to a first embodiment of the present invention will now be described with reference to FIGS. 1–3. The heat generator is used in a vehicle air conditioner.

Figure 1:
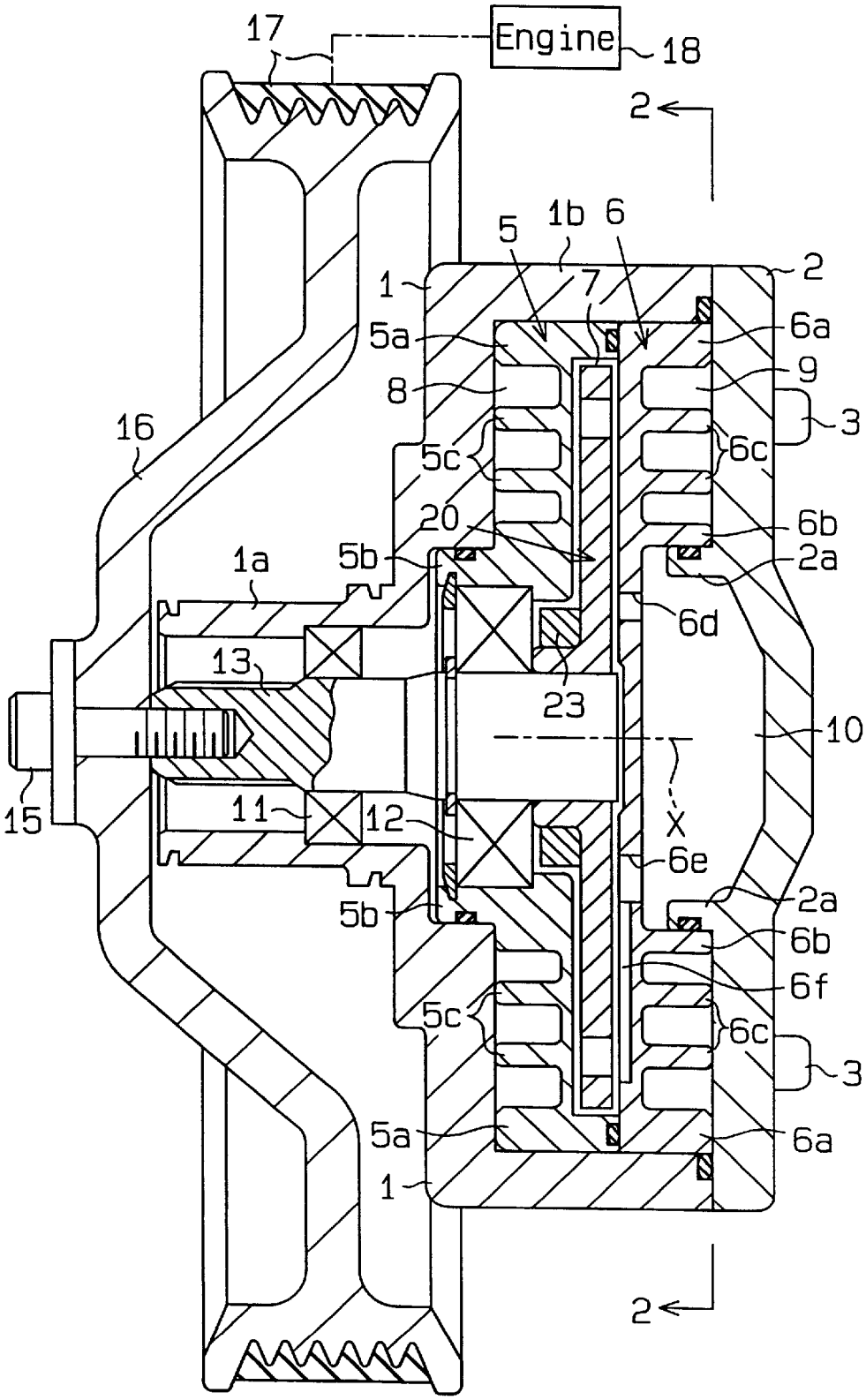
FIG. 1 is a cross-sectional view illustrating a heat generator according to a first embodiment of the present invention.

In FIG. 1, the left side is defined as the front side of the heat generator and the right side is defined as the rear side of the heat generator. As shown in FIG. 1, the heat generator includes a front housing body 1 and a rear housing body 2. The front housing body 1 has a hollow cylindrical boss 1*a*, which protrudes forward, and a cylinder 1*b*, which has a larger diameter than that of the boss 1*a* and extends backward from the proximal end of the boss 1*a*. The cylinder 1*b* has a wide opening opposite to the boss 1*a*. The rear housing body 2 covers the opening of the cylinder 1*b*. The front housing body 1 and the rear housing body 2 are fastened to each other by four bolts 3 (see FIG. 2). The fastened housing bodies 1, 2 accommodate a front plate 5 and rear plate 6. The housings 1, 2 and the plates 5, 6 are made of aluminum alloy.

The plates 5, 6 have peripheral rims 5*a*, 6*a*. When the housing bodies 1, 2 are fastened to each other, the rims 5*a*, 6*a* are pressed against the walls of the housing bodies 1, 2. This fixes the plates 5, 6 relative to the housing bodies 1, 2. A heating chamber 7 is defined between the plates 5, 6.

Figure 2:
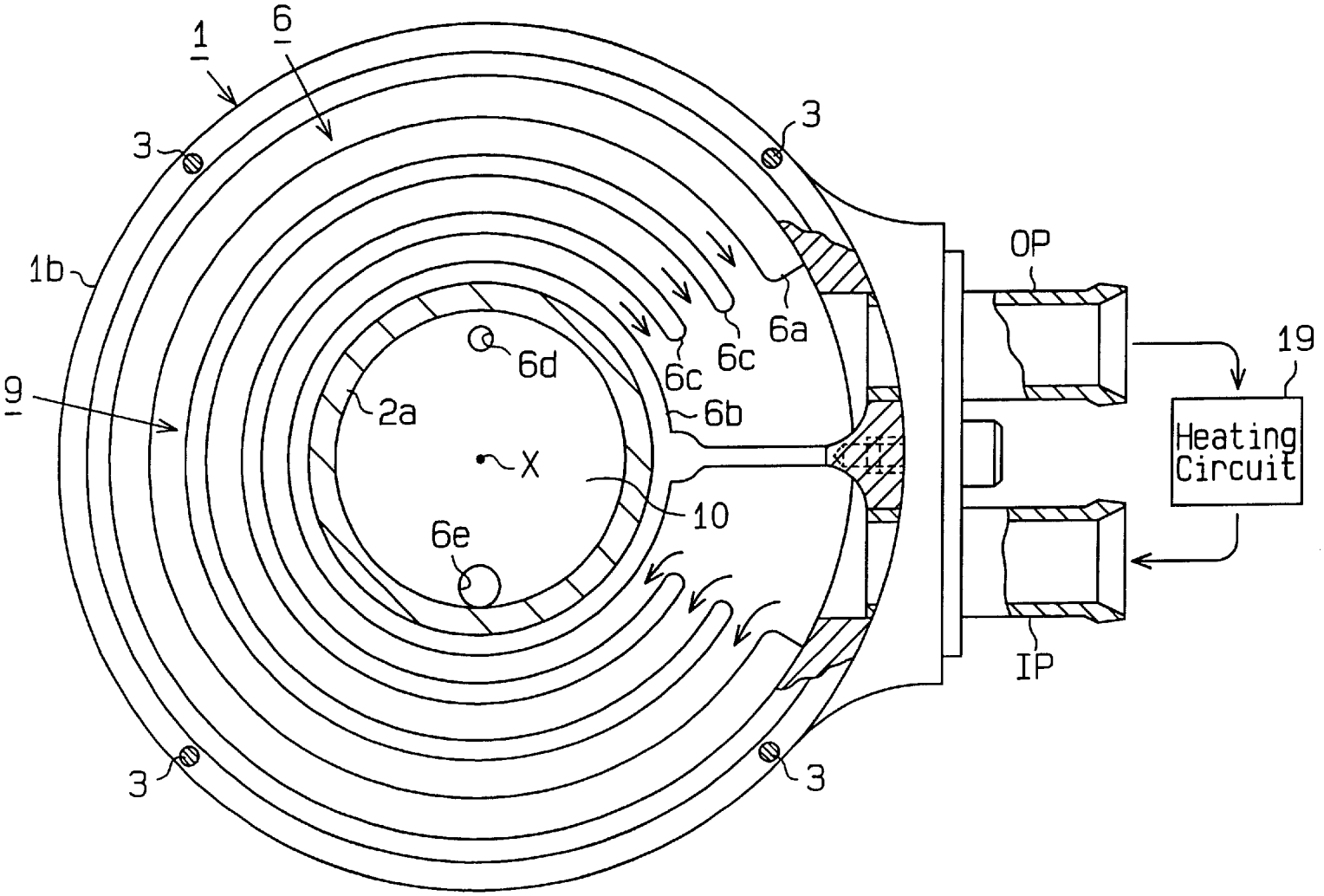
FIG. 2 is a cross-sectional view taken along line 2—2 of FIG. 1.

As shown in FIGS. 1 and 2, the rear plate 6 includes a boss 6*b* extending rearward from the central portion of its rear face and fins 6*c* extending arcuately and concentrically about the boss 6*b*. The fins 6*c* have the same axial dimension as the rim 6*a*. A cylindrical wall 2*a* extends forward from the central portion of the front face of the rear housing body 2. The cylindrical wall 2*a* is press fitted in the boss 6*b*. The inner wall of the rear housing 2 and the fins 6*c* define a rear water jacket 9. The cylindrical wall 2*a* of the rear housing 2 and the boss 6*b* define a reservoir 10. The reservoir 10 is located inside the boss 6*b*. In the rear water jacket 9, the rim 6*a*, the boss 6*b* and the fins 6*c* define water passages and guide the flow of water. The rear water jacket 9 is located behind the heating chamber 7 and functions as a heat exchange chamber.

Like the rear plate 6, the front plate 5 includes a boss 5*b* and fins 5*c*. The boss 5*b* extends forward and is fitted to the inner wall of the front housing 1. The circumference of the boss 5*b* is sealed, for example, by an O ring. The fins 5*c* extend concentrically and arcuately about the boss 4*b*. The axial dimension of the fins 5*c* is the same as that of the rim 5*a*. The inner wall of the front housing 1 and the fins 5*c* define a front water jacket 8. In the water jacket 8, the rim 5*a*, the boss 5*b* and the fins 5*c* define water passages and guide the flow of water. The front water jacket 8 is located in front of the heating chamber 7 and functions as a heat exchange chamber.

As shown in FIG. 2, an inlet port IP and an outlet port OP are formed on the side wall of the front housing 1. The inlet port IP leads circulation water from a vehicle heating circuit 19 into the water jackets 8, 9, and the outlet port OP leads the water from the water jackets 8, 9 to the heating circuit 19. The circulation of the water transmits the heat of the heat generator to the heating circuit 19.

As shown in FIG. 1, a drive shaft 13 is rotatably supported by bearings 11, 12 in the front housing body 1 and the front plate 5. The bearing 12 is located between and seals the boss 5*b* of the front plate 5 and the circumference of the shaft 13.

A substantially disk-shaped rotor 20 is press fitted about the drive shaft 13. The rotor 20 is placed in the heating chamber 7 during assembly of the heat generator. A predetermined clearance exists between the rotor 20 and the heating chamber 7. The structure of the rotor 20 and installation of the rotor 20 to the shaft 13 will be described later.

The rear plate 6 includes upper and lower bores 6*d* and 6*e*, which communicate the heating chamber 7 with the reservoir 10. The cross-sectional area of the lower bore 6*e* is larger than that of the upper bore 6*d*. A radial groove 6*f* is formed on the front face of the rear plate 6.

The heating chamber 7, the reservoir 10 and the bores 6*d*, 6*e* constitute an inner space, which is filled with a predetermined amount of silicone oil (not shown). The amount of the silicone oil is determined such that the fill factor of the oil is fifty to eighty percent of the volume of the inner space at room temperature. The level of the silicone oil is lower than the upper bore 6*d* and higher than the lower bore 6*e*, which functions as a supply passage. When the rotor 20 is rotated, the viscosity of the silicone oil draws the silicone oil out of the reservoir 10 through the lower bore 6*e*. The drawn silicone oil then flows along the groove 6*f* and is evenly distributed in the space between the heating chamber 7 and the rotor 20.

A pulley 16 is secured to the front end of the drive shaft 13 by a bolt 15. A V-belt 17 is engaged with the circumference of the pulley 16. The belt 17 couples the pulley 16 with an engine 18. The engine 18 rotates the drive shaft 13. The rotor 20 is rotated integrally with the drive shaft 13. When rotated, the rotor 20 shears the silicone oil in the space between the inner wall of the heating chamber 7 and the rotor 20, which generates heat. Heat generated in the chamber 7 is transmitted to circulating water in the water jackets 8, 9 through the plates 5, 6. The heated water is then used by the heating circuit 19 for heating the passenger compartment.

Rotation of the rotor 20 causes the silicone oil in the heating chamber 7 to flow toward the drive shaft 13 due to the Weissenberg effect. The upper bore 6*d* is located substantially in the central area of the heating chamber 7. Thus, the silicone oil in the heating chamber 7 is returned to the reservoir 10 through the upper bore 6*d*. On the other hand, due to its high viscosity and its own weight, the silicone oil in the reservoir 10 is drawn to the heating chamber 7 by rotation of the rotor 20. In this manner, rotation of the rotor 20 causes silicone oil to circulate between the heating chamber 7 and the reservoir 10. Since the lower bore 6*e* has a larger diameter than that of the upper bore 6*d*, the amount of oil supplied to the heating chamber 7 exceeds the amount of oil recovered to the reservoir 10. Therefore, silicone oil stored in the reservoir 10 is quickly supplied to the heating chamber 7 through the lower bore 6*e* and flows to the peripheral portion of the heating chamber 7 along the groove 6*f*. The Weissenberg effect quickly moves the silicone oil from the peripheral portion to the center portion of the heating chamber 7. The silicone oil is therefore evenly distributed in the space between the rotor 20 and the wall of the heating chamber 7. Thereafter, the silicone oil is drawn back to the reservoir 10 from the heating chamber 7 through the upper bore 6*d*.

After returning from the heating chamber 7 to the reservoir 10, silicone oil stays in the reservoir 10 for a certain period. Immediately after silicone oil enters the reservoir 10 from the heating chamber 7, the temperature of the oil is high. Some of the heat, however, is transmitted to the rear plate 6 and the housing 2. This lowers the temperature of the silicone oil. Accordingly, the silicone oil is prevented from being heated to high temperatures over a prolonged period and thus damaged.

When the engine 18 is not running, in other words, when the drive shaft 13 is not rotating, the level of silicone oil in the heating chamber 7 is equal to the level of the silicone oil in the reservoir 10. Therefore, when the engine 18 starts rotating the drive shaft 13, the contact area between the rotor 20 and the silicone oil is relatively small. This allows the pulley 16, the drive shaft 13 and the rotor 20 to be driven with relatively little torque.

The structure and installation of the rotor 20 will now be described.

As illustrated in FIG. 1, the rotor 20 includes a disk 21 and a boss 22, which are integrated. The disk 21 shears the silicone oil. The boss 22 includes an inner circumferential surface 22*a* (shown in FIG. 3), for contacting the drive shaft 13. A ring 23 is located about the boss 22. The ring 23 presses the boss 22 against the drive shaft 13, which forms a double structure for securely coupling the rotor 20 to the drive shaft 13.

Figure 3:
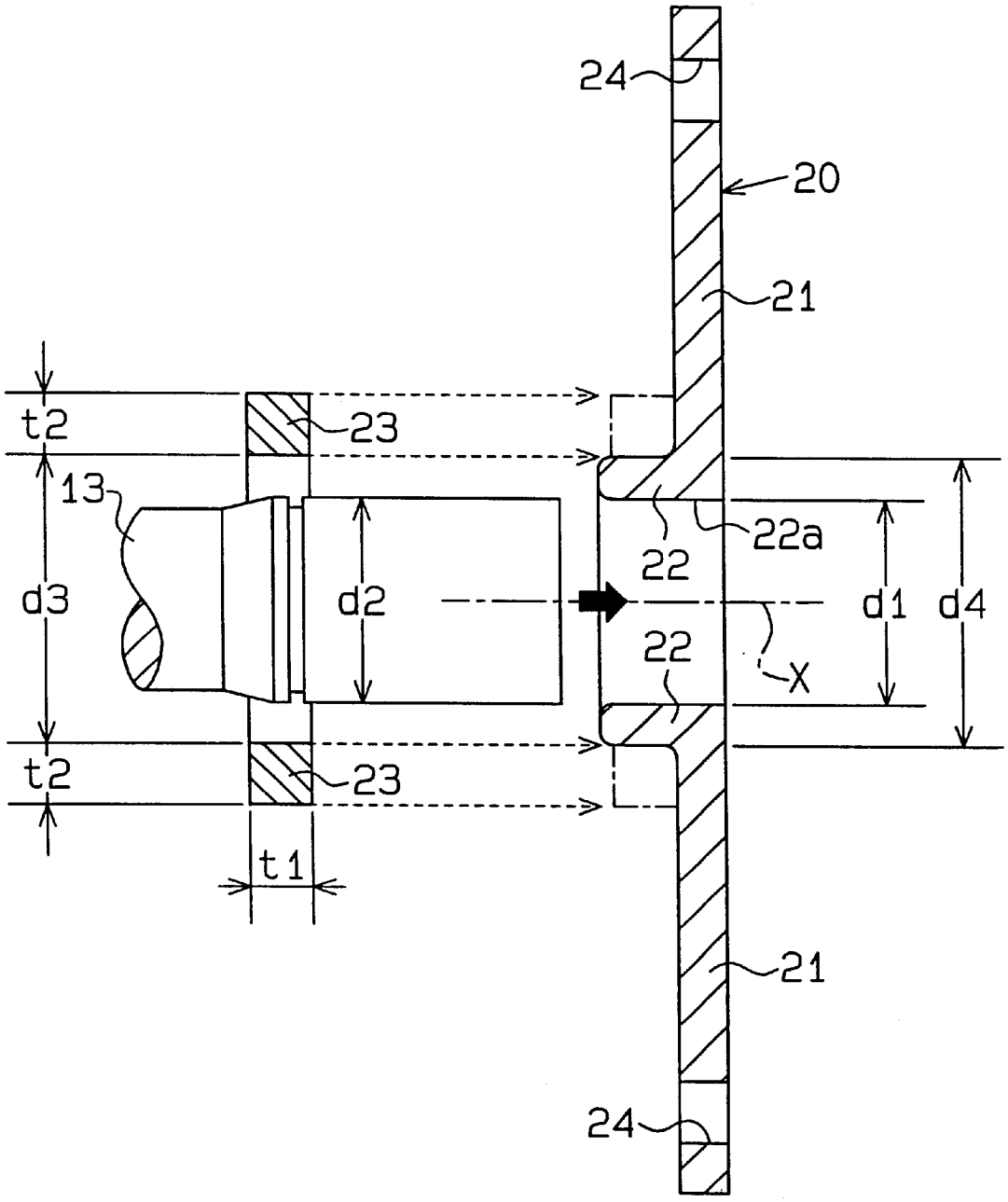
FIG. 3 is a cross-sectional view illustrating a part of the drive shaft and the rotor illustrated in FIG. 1.

As illustrated in FIG. 3, the disk 21 and the boss 22 are integrally formed by pressing a steel plate having a thickness of two to four millimeters. The inner diameter d1 of the boss 22 is slightly smaller than the outer diameter d2 of the drive shaft 13. The boss 22 is formed in the center of the disk 21 by performing deep-drawing. Thus, the thickness of the boss 22 is substantially equal to the thickness of the disk 21, that is, the thickness of the steel plate.

The ring 23 is also formed by pressing a metal plate. The inner diameter d3 of the ring 23 is equal to or slightly smaller than the outer diameter d4 of the boss 22. The axial thickness t1 of the ring 23 is substantially equal to the thickness of the steel plate from which the ring 23 is formed. The radial thickness, or the width t2, of the ring 23 is arbitrarily determined by selecting the press die. The ring width t2 is preferably greater than the radial thickness ((d4−d1)/2) of the boss 22.

Assembly of the rotor 20 to the drive shaft 13 will now be described.

Initially, the drive shaft 13 is press fitted in the boss 22 using a jig. Then, the position of the rotor 20 on the drive shaft 13 is determined. Accordingly, the clearance between the disk 21 and the wall of the heating chamber 7 is determined. Thereafter, the ring 23 is engaged with the drive shaft 13 and fitted about the boss 22. The ring 23 tightly presses the inner circumferential surface 22*a* of the boss 22 against the drive shaft 13. Consequently, the rotor 20 is tightly fixed at the predetermined position on the drive shaft 13.

The disk 21 includes through holes 24. The holes 24 are located at the same distance from the axis X of the drive shaft and are angularly spaced apart at equal intervals. Each hole 24 communicates the clearance at the front side of the rotor 20 and the clearance at the rear side of the rotor 20. The holes 24 promote the circulation of silicone oil thereby equalizing the pressure and the temperature of the silicone oil at the front and rear side of the rotor 20.

The heat generator of FIGS. 1 to 3 has the following advantages.

The ring 23 is used to fix the rotor 20 to the shaft 13. Therefore, although the disk 21 and boss 22 are integral, the rotor 20 does not need to be hardened or subjected to a process for correcting its deformation, which lowers the cost of the heat generator.

The assumed minimum temperature at which the heat generator will be used is minus forty degrees centigrade, and the maximum possible temperature of the silicone oil is two hundred degrees centigrade. Therefore, the temperature of the heating chamber 7 will repeatedly change between minus forty degrees centigrade and two hundred degrees centigrade, if the heat generator is used in the coldest climate. However, the ring 23, which reinforces the attachment of the rotor 20 to the drive shaft 13, prevents the rotor 20 from sliding relative to the drive shaft 13 and allows the rotor 20 to rotate integrally with the drive shaft 13 despite the extreme temperature changes.

The above advantages are unique to the heat generator of FIGS. 1 to 3 in comparison to an exemplary prior art heat generator. The prior art heat generator does not have the ring 23. Instead, the boss 22 is welded to the drive shaft 13. The prior art heat generator was intermittently started and stopped several times in an extremely cold environment. That is, the heat generator was repeatedly subjected to temperature changes between minus forty degrees centigrade and two hundred degrees centigrade. A disassembly of the heat generator thereafter revealed formation of cracks at the welded part between the boss 22 and the drive shaft 13 and that the boss 22 was about to break from the shaft 13. It was apparent that a few more intermittent operations of the heat generator would cause the rotor 22 to slide relative to the drive shaft 13. The heat generator of FIGS. 1 to 3 was subjected to the same experiment. However, there was no abnormality between the boss 22 and the drive shaft 13. That is, the firm attachment between the boss 22 and the shaft 13 was maintained.

Since the ring 23 is separately formed from the rotor 20, the thickness t2 of the ring 23 may be arbitrarily determined. In other words, the pressing force of the boss 22 acting on the drive shaft 13 may be easily changed by varying the thickness t2 of the ring 23.

The rotor 20 is firmly fixed to the drive shaft 13 and does not slide relative to the drive shaft 13. This maintains the clearance between the rotor 20 and the heating chamber 7. Therefore, the heat generator of FIGS. 1 to 3 has a stable heating performance.

It should be apparent to those skilled in the art that the present invention may be embodied in many other specific forms without departing from the spirit or scope of the invention. Particularly, it should be understood that the invention may be embodied in the following forms.

Figure 4A:
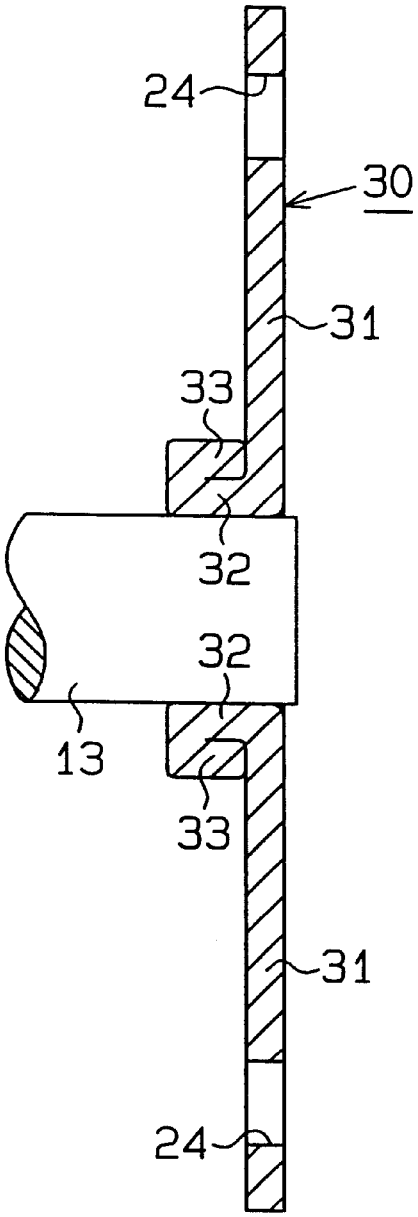
FIG. 4(A) is a cross-sectional view illustrating a heat generator according to a second embodiment of the present invention.

FIG. 4(A) shows a rotor 30 according to a second embodiment. The rotor 30 does not have the separately formed ring 23. The rotor 30 includes a disk 31 and a cylindrical portion 32. The rotor 30, or the disk 31 and the cylindrical portion 32, is integrally formed by pressing a single metal plate. The front end of the cylindrical portion 32 is bent outward. The bent portion 33 contacts the circumferential surface of the cylindrical portion 32. In this manner, the rotor 30 is fixed to the drive shaft 13 by the double-ringed structure of the cylindrical portion 32 and the bent portion 33. In other words, the cylindrical portion 32 and the bent portion 33 form the boss of the rotor 30.

Figure 4B:
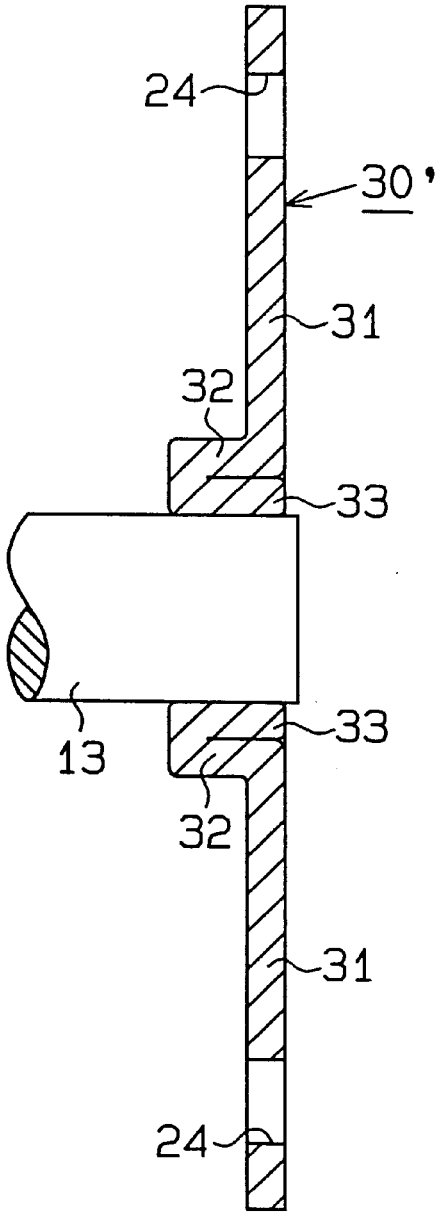
FIG. 4(B) is a cross-sectional view illustrating a heat generator according to a third embodiment of the present invention.

FIG. 4(B) shows a rotor 30' according to a third embodiment. Like the rotor 30, the rotor 30' does not have the separate ring 23. The rotor 30' includes a disk 31 and a cylindrical portion 32. The rotor 30, or the disk 31 and the cylindrical portion 32, is integrally formed by pressing a single metal plate. The front end of the cylindrical portion 32 is bent inward. The bent portion 33 contacts the inner circumferential surface of the cylindrical portion 32. In other words, the cylindrical portion 32 and the bent portion 33 form the boss of the rotor 30.

Figure 5:
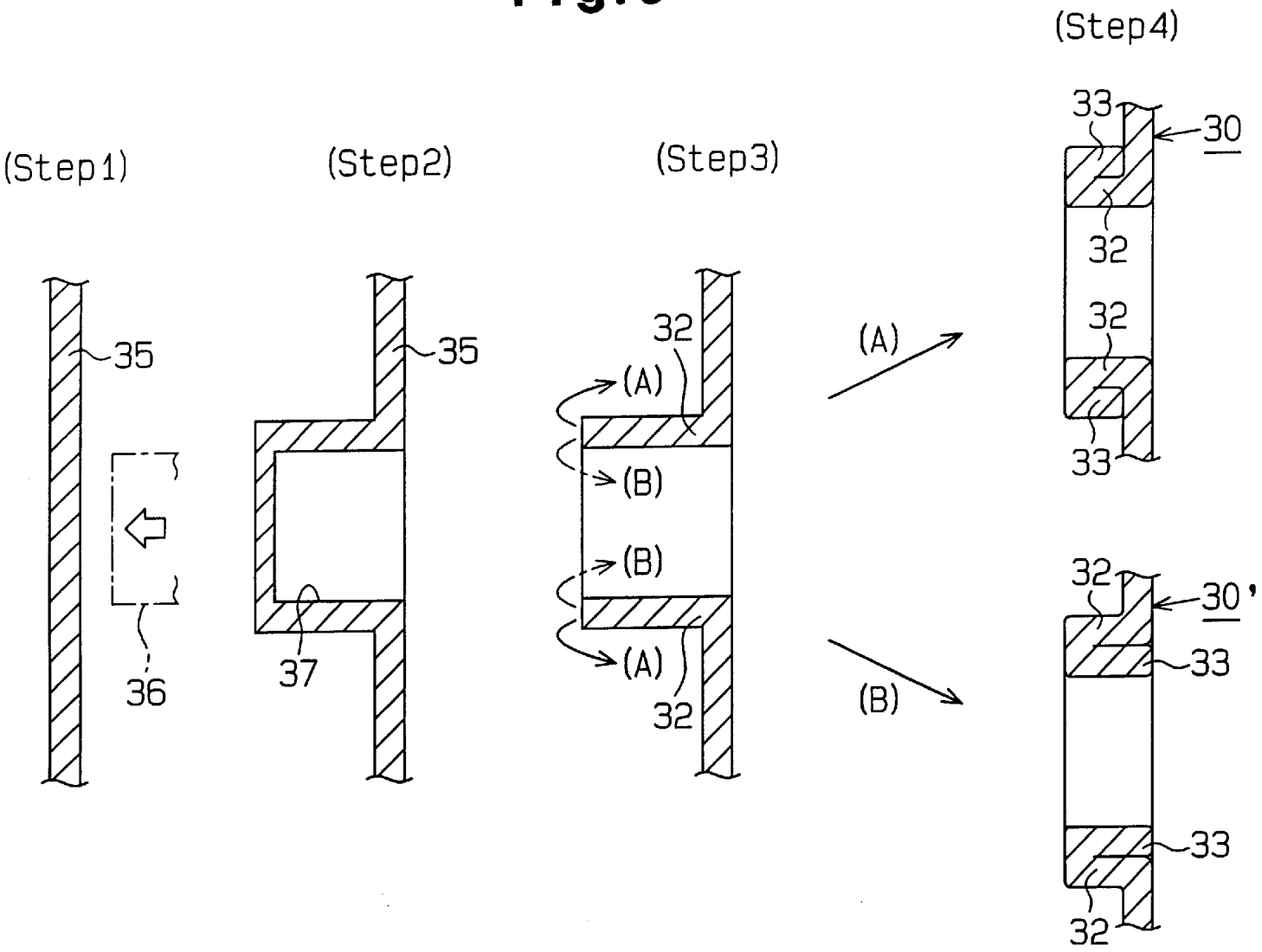
FIG. 5 is a schematic cross-sectional view showing steps in a process for producing the rotors illustrated in FIGS. 4(A) and 4(B).

The manufacturing process of the rotors 30, 30' according to the second and third embodiments will now be described with reference to FIG. 5.

Step 1: a disk-shaped steel plate 35 is prepared. Step 2: a cylindrical press die 36 (shown by a dashed line) is pressed against the plate 35 and forms a recess 37. Step 3: the bottom of the recess 37 is cut off to form the cylindrical portion 32. The front end of the cylindrical portion 32 is bent either (A) outward or (B) inward. Step 4: the outwardly bent portion 33 contacts the cylindrical portion 32 to form the double-ringed boss structure of FIG. 4(A). The inwardly bent portion 33 contacts the cylindrical portion 32 to form the double-ringed boss structure of FIG. 4(B).

The rotors 30, 30' shown in FIGS. 4(A) and 4(B) each have an outer ring of the boss pressing an inner ring against the drive shaft 13. This firmly fixes the rotors 30, 30' to the drive shaft 13. Like the rotor 20 of FIGS. 1 to 3, the rotors 30, 30' do not need to hardened or subjected to a process for correcting their deformation. The manufacturing cost of the heat generator is lowered, accordingly.

In the rotors 30, 30' of FIGS. 4(A), 4(B), the outer ring 33, 32 of the boss may be crimped inwardly. This further enforces the attachment of the rotors 30, 30' to the drive shaft 13.

The separate ring 23 may be employed in the rotors 30, 30' of FIGS. 4(A), 4(B). That is, the ring 23 may be fitted about the boss of the rotors 30, 30' of FIGS. 4(A) and 4(B).

The boss of the rotors 30, 30' may be bent two or more times to form a multiple-ringed boss.

Therefore, the present examples and embodiments are to be considered as illustrative and not restrictive and the invention is not to be limited to the details given herein, but may be modified within the scope and equivalence of the appended claims.

What is claimed is:

1. A heat generator comprising a housing, a heating chamber defined in the housing for accommodating a viscous fluid, a rotor located in the heating chamber, wherein the rotor rotates to shear the viscous fluid to heat the viscous fluid, the heat generator further comprising:

a drive shaft rotatably supported in the housing;

a coupler formed on the rotor, wherein the coupler couples the rotor to the drive shaft; and a fastener for tightening the coupler against the drive shaft.

2. The heat generator according to claim 1, wherein the coupler is a cylindrical boss.

3. The heat generator according to claim 2, wherein the inner diameter of the boss is equal to or slightly smaller than the diameter of the drive shaft.

4. The heat generator according to claim 3, wherein the boss is integrally formed with the rotor by pressing.

5. The heat generator according to claim 4, wherein the fastener is a separate member from the rotor.

6. The heat generator according to claim 5, wherein the fastener has a hole the diameter of which is equal to or slightly smaller than the outer diameter of the boss.

7. The heat generator according to claim 6, wherein the fastener is press fitted about the outer surface of the boss thereby pressing the boss against the drive shaft.

8. The heat generator according to claim 4, wherein the fastener is integral with the rotor and is formed by bending a part of the boss.

9. The heat generator according to claim 1, wherein the rotor is rotated by a vehicle engine, and wherein heat generated by the heat generator is used for heating a vehicle passenger compartment.

10. A heat generator comprising:

a housing;

a heating chamber formed within the housing for containing viscous fluid;

a rotor located in the heating chamber for being rotated by rotation of the drive shaft to shear the viscous fluid to generate heat, the rotor being coaxially supported by the drive shaft, wherein the rotor comprises:

a hollow sleeve formed at the center of the rotor such that a center axis of the sleeve coincides with the axis of the drive shaft, wherein the sleeve is integral with and projects axially from the rotor; and a fastener ring tightly and concentrically fitted around the sleeve to compressively hold the sleeve against the drive shaft for securing the rotor to the drive shaft.

11. The heat generator of claim 10, wherein the fastener ring is separate from the sleeve and is press fitted to the sleeve.

12. The heat generator of claim 10, wherein the fastener ring is integral with the sleeve and is formed by folding a portion of the sleeve by 180 degrees.

13. A method for manufacturing a heat generator having a housing, a heating chamber defined in the housing for containing a viscous fluid and, a rotor located in the heating chamber, wherein the rotor rotates to shear the viscous fluid to heat the viscous fluid, the method comprising:

forming a coupler on the rotor for coupling the rotor to the drive shaft, by pressing the center of a plate to form a projection that conforms to the shape of the drive shaft;

bending a distal section of the coupler by 180 degrees to form a double-ringed cylindrical structure; and fixing the coupler to the drive shaft by inserting the drive shaft into the coupler.

14. A heat generator comprising:

a housing;

a heating chamber defined in the housing for accommodating a viscous fluid;

a rotor located in the heating chamber, wherein rotation of the rotor causes shearing of the viscous fluid, heating the viscous fluid;

a drive shaft rotatably supported in the housing;

a coupler on the rotor, the coupler coupling the rotor to the drive shaft, wherein the rotor and the coupler are a single piece; and a fastener for tightening the coupler against the drive shaft.

15. A heat generator comprising:

a housing;

a heating chamber defined in the housing for accommodating a viscous fluid;

a rotor located in the heating chamber, wherein the rotation of the rotor causes shearing of the viscous fluid, heating the viscous fluid;

a drive shaft rotatably supported in the housing;

a coupler formed on the rotor, the coupler coupling the rotor to the drive shaft; and a fastener for bearing against the coupler to tighten the coupler to the drive shaft by applying a force on the coupler towards the drive shaft, perpendicular to the drive shaft.

16. A heat generator comprising:

a housing;

a heating chamber defined in the housing for accommodating a viscous fluid;

a rotor located in the heating chamber, wherein rotation of the rotor causes shearing of the viscous fluid, heating the viscous fluid;

a drive shaft rotatably supported in the housing;

a coupler formed on the rotor, the coupler coupling the rotor to the drive shaft; and a fastener ring concentrically fitted around the coupler, for tightening the coupler against the drive shaft.

17. A heat generator comprising:

a housing;

a heating chamber defined in the housing for accommodating a viscous fluid;

a rotor located in the heating chamber, wherein the rotor rotates to shear the viscous fluid to heat the viscous fluid;

a drive shaft rotatably supported in the housing;

a cylindrical boss formed on the rotor, the cylindrical boss coupling the rotor to the drive shaft, wherein the boss is integrally formed with the rotor; and a fastener for tightening the coupler against the drive shaft, wherein the fastener is integral with the rotor and is formed by bending a part of the boss.

18. A heat generator comprising:

a housing;

a heating chamber defined in the housing for accommodating a viscous fluid;

a rotor located in the heating chamber, wherein the rotor rotates to shear the viscous fluid to heat the viscous fluid;

a drive shaft rotatably supported in the housing;

a cylindrical boss formed on the rotor, the cylindrical boss coupling the rotor to the drive shaft, wherein the boss is integrally formed with the rotor; and a fastener for tightening the coupler against the drive shaft, wherein the fastener is a separate member from the rotor.

19. The heat generator according to claim 18, wherein the fastener has a hole having a diameter equal to or slightly less than the outer diameter of the boss.

20. The heat generator according to claim 19, wherein the fastener is press fitted about the outer surface of the boss, thereby pressing the boss against the drive shaft.

21. A heat generator comprising:

a housing;

a heating chamber defined in the housing for accommodating a viscous fluid;

a rotor located in the heating chamber, wherein the rotor rotates to shear the viscous fluid to heat the viscous fluid by a vehicle engine;

a drive shaft rotatably supported in the housing;

a cylindrical boss formed on the rotor, the cylindrical boss coupling the rotor to the drive shaft, wherein the boss is integrally formed with the rotor; and a fastener for tightening the coupler against the drive shaft, wherein the fastener is a separate member from the rotor, and heat generated by the heat generator is used for heating a vehicle passenger compartment.

22. The heat generator according to claim 21, wherein the cylindrical boss has an inner diameter equal to or slightly less than the diameter of the drive shaft and the fastener has a hole having a diameter equal to or slightly less than the outer diameter of the boss.

23. The heat generator according to claim 22, wherein the fastener is press fitted about the outer surface of the boss, thereby pressing the boss against the drive shaft.

24. A heat generator comprising:

a housing;

a heating chamber defined in the housing;

a rotor located in the heating chamber, wherein the rotor rotates to shear the viscous fluid to heat the viscous fluid;

a drive shaft rotatably supported in the housing;

a cylindrical boss formed integral with the rotor, the cylindrical boss comprising first and second concentric rings, the cylindrical boss coupling the rotor to the drive shaft; and a fastener for tightening the coupler against the drive shaft.

* * * * *